US005437520A

United States Patent [19]

Cherry et al.

[11] Patent Number: 5,437,520

[45] Date of Patent: Aug. 1, 1995

[54] SEALING SYSTEM FOR IN-GROUND BARRIER

[75] Inventors: John A. Cherry; Enoch S. Vales, both of Waterloo, Canada

[73] Assignee: University of Waterlo, Waterloo, Canada

[21] Appl. No.: 232,293

[22] PCT Filed: Nov. 6, 1992

[86] PCT No.: PCT/GB92/02057

§ 371 Date: May 4, 1994

§ 102(e) Date: May 4, 1994

[87] PCT Pub. No.: WO93/09298

PCT Pub. Date: May 13, 1993

[30] Foreign Application Priority Data

Nov. 8, 1991 [GB] United Kingdom ..... 9123771
Sep. 17, 1992 [GB] United Kingdom ..... 9219652

[51] Int. Cl.[6] ..... E02D 5/08

[52] U.S. Cl. ..... 405/279; 405/276; 405/278; 405/281

[58] Field of Search ..... 405/274–281

[56] References Cited

U.S. PATENT DOCUMENTS

| | | | |
|---|---|---|---|
| 1,411,905 | 4/1922 | Boardman | 405/278 |
| 1,896,259 | 2/1933 | Thackray | 405/278 |
| 2,558,367 | 6/1951 | Madsen | 405/278 X |
| 3,302,412 | 2/1967 | Hunsucker | 405/278 |
| 3,492,826 | 2/1970 | Horstketter et al. | 405/281 |
| 3,688,508 | 9/1972 | Taylor | 405/278 |
| 4,981,540 | 1/1991 | Prochhorst | 405/278 X |

FOREIGN PATENT DOCUMENTS

| | | | |
|---|---|---|---|
| 0012424 | 2/1981 | Japan | 405/277 |
| 0111717 | 9/1981 | Japan | 405/278 |
| 428398 | 12/1934 | United Kingdom . | |

*Primary Examiner*—Dennis L. Taylor
*Attorney, Agent, or Firm*—Anthony Asquith & Co.

[57] ABSTRACT

The joints between pile-driven sheet metal barrier elements (12, 14) have edge forms which interlock so as to form cavities (20, 21). The cavities extend from top to bottom of the barrier, and allow a flushing hose to be inserted to the foot of the barrier. Sealant is injected when the cavity is flushed clean. Two cavities are provided side by side at each joint. The cavities are independently sealed for extra reliability.

16 Claims, 3 Drawing Sheets

SEALING SYSTEM FOR IN-GROUND BARRIER

This invention relates to in-ground barriers, of the kind that comprise pile-driven elements of sheet material, and the like. Such barriers are often required to be watertight, or at least to be leak resistant.

BACKGROUND TO THE INVENTION

Patent publication GB-2228760 (VALES, published 05 Sept 1990) shows an arrangement of the interlocking edge forms of the elements of a barrier, the illustrated arrangement being highly effective to resist leakage. The present invention may be regarded as an improvement to that type of interlocking edge-form arrangement.

In VALES, one of the key aspects is that a cavity is created in the potential leak path that exists between two interlocking elements. The cavity is defined by the profiles of the interlocking edge forms. The cavity is large enough that a hose pipe may be passed down the cavity, and water then may be flushed through the cavity. When the cavity is flushed out, an injecting or dispensing pipe may be inserted into the cavity, and a sealant and/or adhesive may be injected into the cavity.

The present invention is aimed at improving the reliability with which the sealed junctions of this general type can be regarded as leak proof.

GENERAL FEATURES OF THE INVENTION

The invention consists in a leak-resistant barrier. Each element of the barrier has a senior edge form which interlocks with, and is pile-driven or otherwise inserted ahead of, a junior edge form of the next adjacent element.

In the invention, the configurations of the interlocking pairs of senior and junior edge forms are such that the configurations thereof jointly form the circumferences of two enclosed cavities.

In respect of each one of the two enclosed cavities, a portion of the circumference of the enclosed cavity is constituted by a portion of the senior edge form, and another portion of the circumference of that same enclosed cavity is constituted by a portion of the interlocking junior edge form.

In respect of both cavities, the portion of the circumference of the cavity constituted by the junior edge form preferably is the major portion of that circumference.

The barrier includes means for keeping the said enclosed cavities clear of dirt and debris when the barrier is installed. Preferably, this takes the form of scrapers attached to the foot of the junior edge form, which act to deflect the dirt and debris laterally away from the cavities as the junior edge form is driven onto the senior.

In respect of each one of the two enclosed cavities, the edge forms are so shaped that each enclosed cavity includes a respective clear, open space, which is defined by and inscribed wholly within the enclosed cavity, the inscribed circle being clear and open in that no portion of the material of either of the elements encroaches into the said inscribed circle. This clear, open space permits the insertion into the cavity of the flushing hose and/or a sealant injecting tube. The cavity is open from top to bottom of the barrier, so that the hose can be inserted from the surface all the way down to the bottom of the barrier. The inscribed circle is preferably of at least 18 mm diameter.

As mentioned, the interlocking senior and junior edge forms jointly form the whole circumferences of the cavities, with the result that potential leakpaths are created between the edge forms. It is arranged that each and every leakpath starting from in front of the barrier and finishing behind the barrier is in communication with the said two enclosed cavities, and in fact the interlocking edge forms are so arranged that all the potential leakpaths traverse through both the cavities, in series.

The interlocking adjacent elements are so arranged as to include an interlocking dovetail connection, being a connection which is effective to prevent lateral displacement of the senior edge form relative to the interlocking junior edge form and to prevent consequent distortion of the cavity, the prevented displacement being displacement of such magnitude as to cause such lateral distortion of the cavity wherein the open, clear inscribed circle preferably is less than 18 mm diameter. In the invention, the cavities are held rigidly apart and open at all locations of the height of the barrier; if the edge forms were allowed to approach each other, the resulting mismatch between the edge forms might be such that the cavities would no longer be sufficiently wide open as to receive the flushing hose.

Preferably, the interlocking edge forms are of constant configuration from top to bottom of the elements, whereby, when the barrier is installed in the ground, each of the two cavities is clear, open, and accessible from top to bottom of the barrier.

THE PRIOR ART

A previous proposal for a barrier which has two cavities at a joint is shown in U.S. Pat. No. 3,302,412 (HUNSUCKER, published 07 Feb 1967). The present invention differs from Hunsucker in that in Hunsucker, both cavities are filled with adhesive from the one filling point: sealant material flows out of one cavity into the other. In the invention, sealant is inserted, from the surface, into the two cavities independently. In the present invention, also the flushing hose can be passed from top to bottom of the cavities independently.

Because of these differences, the two cavities can be regarded as being independent as regards sealing performance and efficiency. The leak resistance of the combined double cavity joint, with the arrangement of the invention, is the product of the leak resistances of the two individual cavities; in Hunsucker, the combined leak resistance is no more than the sum of the individual leak resistances.

Preferably, both cavities are so formed that the junior element forms the major portion of the circumference of the cavity. In respect of both cavities, where scrapers are provided at the foot of the junior element to clean out the cavities as the junior element is driven in, two advantages arise because the junior portion of the circumference is large: first, the scraper, which sometimes can be vulnerable to being damaged during driving, is attached to the junior edge form over a large area; and second, since the senior edge form portion of the circumference is small, it is easy for the dirt and debris to be ejected from the cavity.

In Hunsucker, the cavities are symmetrical: in the invention, the cavities are not symmetrical in that, in respect of both cavities, preferably the junior edge form supplies the major portion of the circumference of the cavity.

As regards the dovetail connection, it is preferred that the elements be so arranged as to include no redundant dovetail connections. If the elements were to be too well located with respect to each other, for example if two or more dovetail connections were provided at the joint, the dovetail connections might "fight" each other. The one dovetail connection rigidly prevents the edge forms from approaching or separating, both in the front/back sense and in the left/right sense, but sheet piling elements inevitably cannot be made to high degrees of dimensional tolerance, and slight inaccuracies must be expected. Apart from the one dovetail connection, therefore, the fit of the elements on each other should be quite loose.

DETAILED DESCRIPTION OF PREFERRED EMBODIMENT

By way of further explanation of the invention, exemplary embodiments of the invention will now be described with reference to the accompanying drawings, in which.

The items shown in the accompanying drawings and described below are examples which embody the invention. It should be noted that the scope of the invention is defined by the accompanying claims, and not necessarily by specific features of exemplary embodiments.

Figure 1:
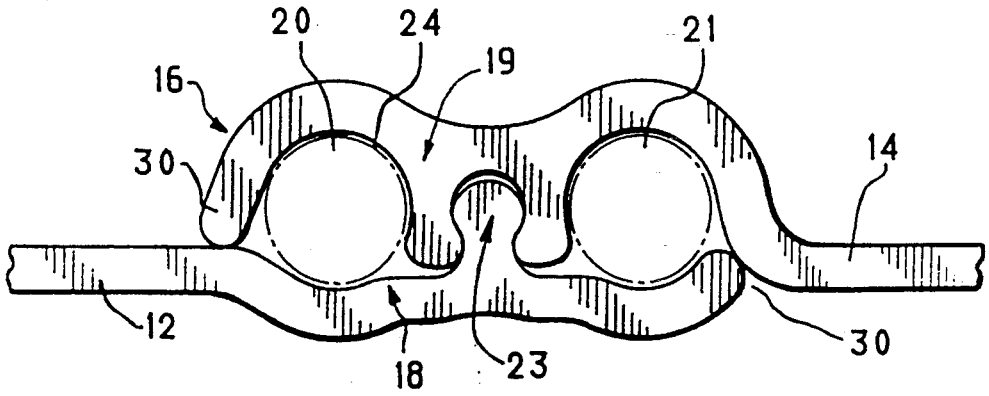
FIG. 1 is a plan view in cross-section of a portion of an in-ground barrier, showing a particular configuration of pile-driven sheet metal barrier elements.

FIG. 1 is a plan of an area of ground, viewed from above, into which has been driven, by pile-driving, two sheet metal elements 12,14. The elements 12,14 are joined at a junction 16, which is aimed at being watertight.

The element 12 is formed with a right-hand edge-form 18, and the element 14 is formed with a left-hand edge-form 19, the two edge-forms being in interlocking engagement. The edge-forms 18,19 can be assembled only vertically. Once assembled together, the elements can only be separated by relative sliding of the edge forms vertically. The edge forms, when interlocked, locate and hold the two elements, in the lateral sense, very firmly relative to each other.

The whole barrier is made up of elements joined together by means of junctions like junction 16.

The interlocking edge forms 18,19 define a pair of cavities 20,21. Each of these cavities is roughly circular in outline, though not exactly so, as may be seen. Each cavity is large enough that a clear circle 23 of diameter about 2 cm can be inscribed inside the plan view of the cavity.

The size of the inscribed circle, which defines the clear cavity, should be such that a flushing hose can be easily passed down the cavity from top to bottom. The cavity should also be large enough that, when the flushing hose is in place, flushing water from the hose can pass up the cavity, around the hose, and out at the surface. The type of hose that would be contemplated for use with a practical barrier would be of standard half-inch size: the practical minimum diameter of the inscribed circle for use with such a flushing hose is about 18 mm.

The elements include a dovetail connection 23. By means of the dovetail connection, when the edge-forms are interlocked, there can be substantially no lateral movement of the edge-forms relative to each other. The edge-forms should be so shaped as to prevent the edge-forms from moving laterally—from approaching each other, for instance—because such approach would encroach into the inscribed circles 24.

On the other hand, the edge-forms should not be so tight to each other that they interfere: when the elements are being pile-driven, such tightness can cause high friction forces to develop at the points of contact, which can even be sufficient to heat the metal to the point of fusing.

The fact that there are two cavities is important, as will become clear.

Figure 2:
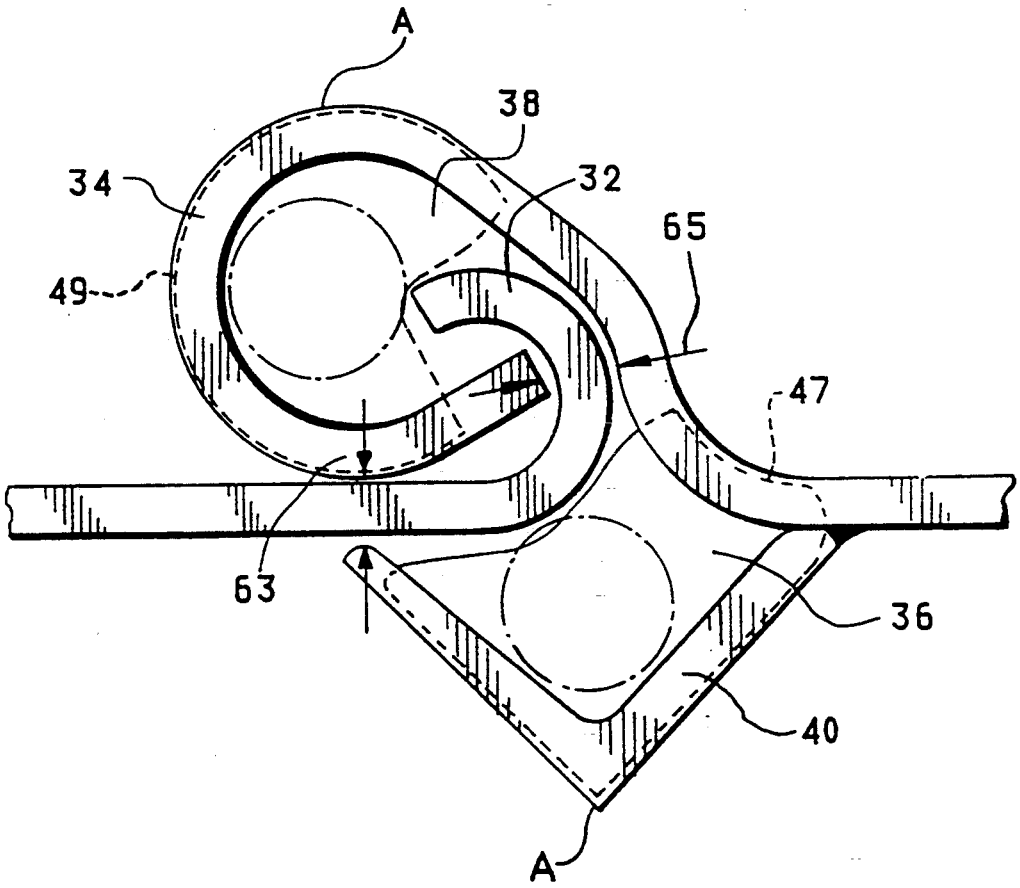
FIG. 2 is a corresponding view of a second barrier.

FIG. 2 illustrates another arrangement of interlocking edge-forms in which two cavities are provided. In FIG. 1, the edge-forms 18,19 were created by hot-rolling, in which the metal is upset, ie the cross-sectional thickness of the metal is changed and deformed. In FIG. 2, the edge forms 32,34 were produced by cold-rolling, in which the metal can be bent, but substantially cannot be deformed as to its thickness.

In FIG. 2, two cavities 36,38 are provided. One cavity 38 is formed by a loop in the edge forms, whereas the second cavity 36 is formed by welding on an extra piece 40 of metal. It may be noted that the welding can consist of intermittent short tack-welds, there being no need for the welded seam itself to be watertight. Although welding is labour intensive, cold rolling may be preferred as an inexpensive process for short production runs.

As described in GB-2228760, a scraper is provided at the foot of the elements, and the scraper acts to clear dirt and debris out of the cavity. With the presence of the scraper, when the pile elements are fully driven into the ground, each cavity may be expected to be open down to the bottom of the barrier. That is to say, the cavities can be expected to be free from large pebbles.

However, the cavities cannot be expected to be dirt free. If any dirt should be present in the cavity, the sealant might not penetrate into all the crannies of the potential leak paths between the elements. Also, even with the scraper present, larger debris sometimes does collect inside the cavity.

Generally, if the soil into which the barrier is being inserted is homogeneous sand and gravel, the cavities will be free of dirt and debris, and the sealant will be complete and the joint leakproof.

But the ground into which the barrier is installed may be a soil mixture of gravel and clay. Or the ground may include dried out, cracked clay. It is possible for such cohesive clay material to enter the cavity in not insignificant quantities. Once in, it is possible for a clump of the cohesive material to coalesce, and to adhere to the inside walls of the cavity.

It is even possible for the walls of the cavity to be lined with sticky clay, to the extent that the clay defines a tube, down which the flushing hose may pass in that case, it might be possible for the engineer to determine that there is no obstruction in the cavity, and yet the sealant injected into the cavity cannot actually reach and touch the inside walls of the cavity.

Therefore, even with the cavity/scraper/flush system as described in GB-2228760, it is still possible, especially in certain kinds of soils, that the injected sealant might not be fully effective to produce a leak-proof cavity.

On the other hand, the number of cavities that do leak can be expected to be small. The provision of two independently-sealed cavities at the same junction, then, as a matter of statistical chance, virtually eliminates the chance of a leak.

For example, if the cavity/scraper/flush system can be expected to leak at the rate of one in a thousand joints (which would be of some concern), if two independently-sealed cavities are provided the expected leak rate goes to one in a million joints (which can be ignored).

It should be emphasized that even when the flushing hose will pass freely right down to the foot of the cavity, with some kinds of soil that is still not enough to be sure that there might not be some dirt still adhering to the walls inside the cavity.

Even more so, the joint cannot be expected to be fully sealed if the cavity is in fact found to contain a detectable obstruction of some kind, whereby the flushing hose cannot pass right down the cavity. It is recognised that, even with all the precautions taken to keep the cavity clear, it still can happen that a pebble etc can become lodged in the cavity.

If this does happen, it will invariably not be discovered until the barrier is fully inserted. It is usually impossible to take out just a single element of the barrier, clean it, and then put that element back. Usually, the whole barrier has to be taken out if it is desired to clear an obstruction from just one cavity.

This is of course an horrendous penalty, and the temptation on the part of the contractor is often to simply inject the sealant into the cavity as far down as he can, and keep quiet about the obstruction. It may be years before it is discovered that the joint is in fact leaking, especially if leaking were not suspected.

With the provision of the two cavities per joint, the chance of the two cavities at the same joint being both blocked by pebbles can be ignored. Both cavities can be made to serve to seal the joint, independently of the other. This source of potential leakage therefore is virtually eliminated by the provision of double cavities.

Another reason for preferring double cavities is that different sealants and/or adhesives can be placed in the two cavities. For instance, a particularly active sealant or adhesive might be very good for sealing certain kinds of contamination, but might itself put toxic traces into water. In that case, the engineer might elect to inject the active material into one cavity, whilst a more inert passive material could be inserted into the other cavity.

It may be preferred in some cases to use a two-component adhesive/sealant (many of the foaming sealants are of the two-component type, for example). The double cavity arrangement permits the two components not to be pre-mixed, but to be kept separate until the components are actually in place. (Once a two-component sealant has been mixed, it must be used immediately, which can pose some operational restrictions.)

It will be noted that the double cavity arrangement actually provides not only the two cavities, but also provides a path between the two cavities. This path is more or less narrow and tortuous. Some kinds of adhesive are bulk sensitive, in that they will set or cure differently in a narrow pathway, as compared with their activity when in a large bulk. The double cavities provides both large bulk areas and narrow tortuous areas, so that both kinds of properties may be catered for. The kinds of sealants and/or adhesives inserted into the cavities must usually be the kinds that will set and cure while immersed in water, and those kinds can be especially sensitive to the tortuous-pathway/in-bulk difference.

In the FIG. 1 arrangement, the elements 12, 14 are so firmly held by the edge forms 18, 19 as to be extremely resistant to articulation between the elements. In fact, in the arrangement of FIG. 1, it will be seen, the provision of the two cavities allows the furthermost contact points 30, at which the two edge forms engage each other, to be very well spaced out, which makes the joint highly resistant to articulation.

This resistance to articulation is an advantage in ensuring that the elements do not wander out of line below ground. If such resistance to articulation were not provided, the fully inserted elements might, if the ground were uneven, be rippled and almost wavy. So long as the joint is still leak proof that perhaps does not matter, but the effect is not self correcting and later driven elements pick up all the out of line errors of the already inserted elements, and the cumulative misalignments can be troublesome. An arrangement of the joint that permits articulation therefore is mainly suitable for plain sands and gravels, where there are unlikely to be non-homogeneities of sufficient substance to drive the element off line.

If boulders etc are embedded in clay, the high articulation-resistance of the FIG. 1 arrangement, by contrast will often permit the driven element actually to fracture a boulder that lies in the line of the element, rather than be deflected aside by it.

It may be noted that this high articulation resistance, which comes from having the contact points 30 between the edge forms spaced well apart, arises virtually without cost when the double cavities are provided, as shown in FIG. 1. On the other hand, the double cavities can be provided while still allowing the joint to articulate, if the nature of the ground, the layout of the barrier, etc permit, or dictate, that that is preferred.

Figure 3:
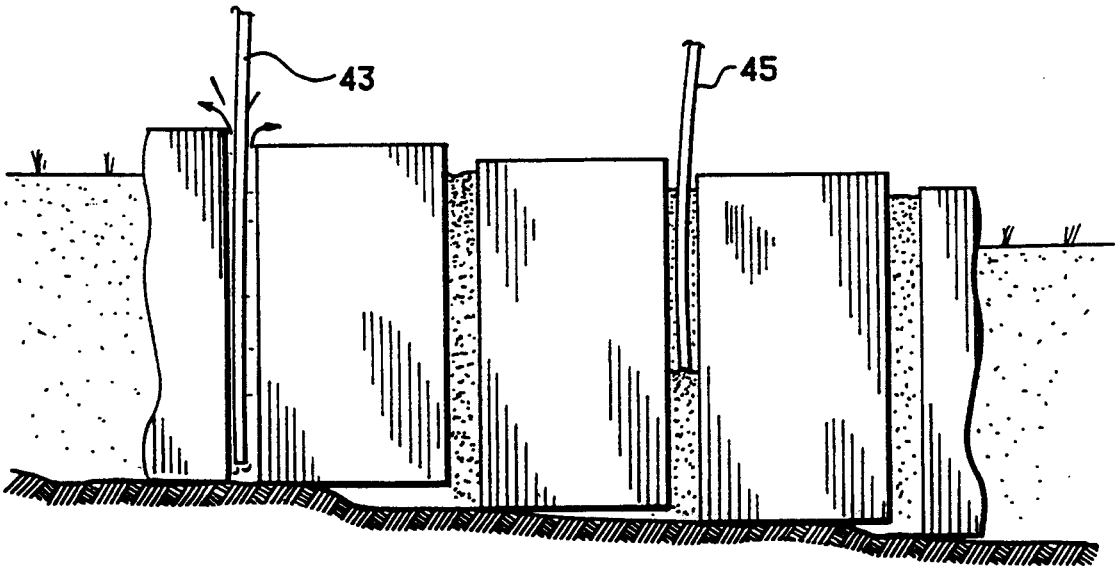
FIG. 3 is a side elevation of a barrier that has been installed in the ground, and in which the operations of cleaning out the cavities and inserting sealant are being conducted.

FIG. 3 shows a barrier in which the elements have been fully driven into position. A hose 43 is passed down right to the bottom of one of the cavities, and the water supply is turned on. The water from the hose passes up through the cavity, around the hose, flushing out such dirt and debris as may be present, until the water runs clear. Next, a dispensing pipe 45 is inserted to the bottom of the cavity, and sealant/adhesive is injected though the pipe as required. The dispensing pipe is progressively withdrawn up the cavity as the sealant is injected into the cavity. These two operations are carried out in respect of both cavities at each junction.

As mentioned, at the foot of the edge forms is attached a scraper. The elements are driven in sequence, and the first-driven element of an adjacent pair is termed the senior element, and the last-to-drive element is termed the junior element. The final outline of the cavity is defined in part by the edge form of the metal of the senior element and in part by the edge form of the metal of the junior element.

The scraper is attached at the foot of the junior element, and its function is to pass down around the shape of the edge form of the senior element as the elements are driven together, and to deflect aside any dirt, pebbles, etc as may be present in what will be the cavity.

When two cavities are provided, each is furnished with a scraper.

FIG. 2 shows the scrapers in plan view, looking down from above the elements. Both scrapers 47,49 are attached to the foot of the junior edge form 34. The drawing shows the extent to which the scrapers are supported by the shape of the junior element. A scraper of course encounters serious abusive forces if it should happen to encounter a troublesome obstruction, and its function is to remove that obstruction. Therefore, it is preferred that the scraper should be well-supported on and by the foot of the junior edge form: the scraper should not, for example, be welded at a single narrow point, and cantilever out for a large distance.

It is preferred that the junior edge form should constitute a major proportion of the outline of the whole cavity, for two reasons:

first it is preferred that the junior-formed portion of the cavity be large, because there is then ample material in the junior edge-form which is available for attaching the scraper without much cantilevering;

and secondly it is preferred that the senior-formed portion of the cavity be small, because the senior edge-form is then wide open and can easily release, ie will not entrap, any debris materials that may be deflected by the scraper.

Thus, it is preferred, from this standpoint, that the profiles of the junior and senior edge forms not be the same as each other but that, as in FIGS. 1 and 2, the junior profile constitute the major share of the whole cavity profile, in respect of both cavities.

The scraper should lie at an angle, whereby it can deflect the materials it encounters sideways out of the cavity, rather than simply compressing the materials underneath the scraper.

Figure 5:
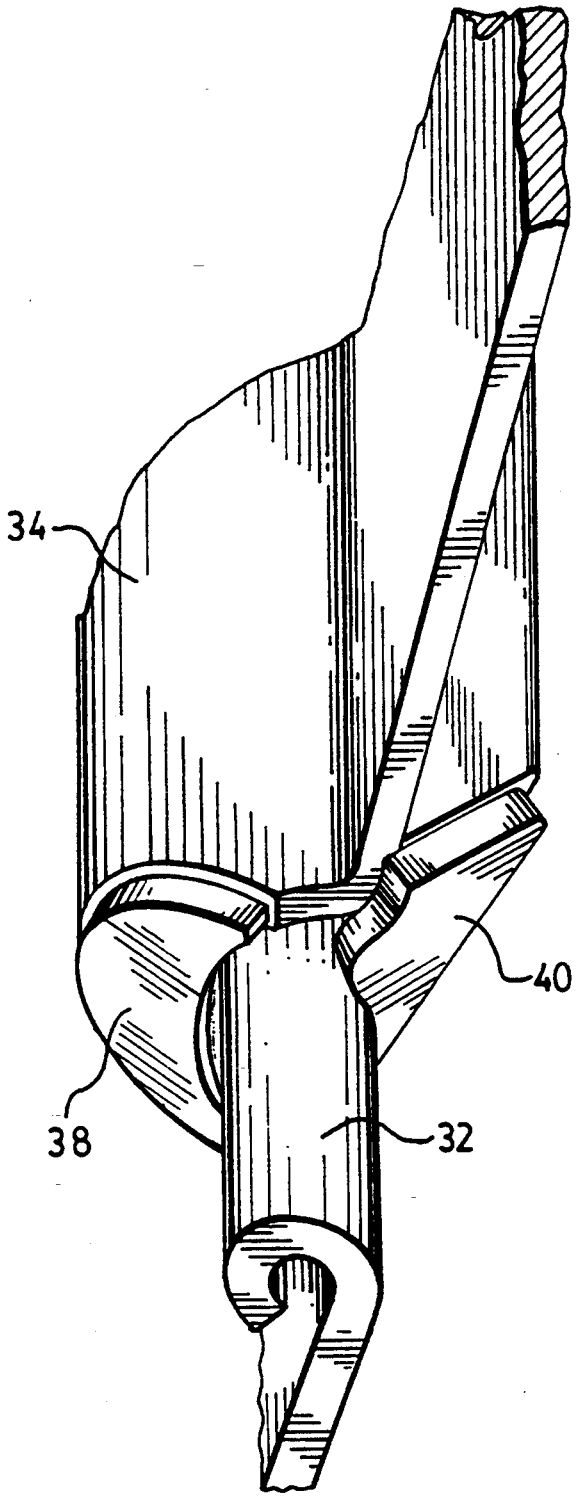
FIG. 5 is a pictorial view from below of the pair of interlocking elements shown in FIG. 2.

FIG. 5 shows the two scrapers 47,49 disposed one either side of the senior element. The two scrapers are arranged in V-formation, whereby the forces due to debris being deflected are substantially equalised, and the tendency of the barrier to be deflected laterally is minimised. FIG. 5 shows the foot of the elements of FIG. 2. However, the V-formation is not essential, and the scrapers for the other joints illustrated will not have the symmetrical V-formation, as may be understood from a perusal of the plan views thereof.

The preferred orientation for the angle of the scraper is that the scraper should be angled so that points A of the FIG. 2 form are uppermost. This means cutting the foot of the junior edge form at the appropriate angle. The scraper is a small piece of sheet metal welded to the angled surface of the foot of the junior edge-form.

For two cavities, a one-piece scraper covering both cavities, or two separate scrapers, may be provided. The FIG. 1 arrangement lends itself to a one-piece scraper. So does the FIG. 4 arrangement. Of course, a one-piece scraper is inappropriate for the arrangement of FIGS. 2,5.

In fact, the preferred scraper angle for the two cavities need not be the same. In this case, two angled faces may be cut at the foot of the junior edge form, each lying at a different angle. Alternatively, especially when a one-piece scraper is being used, a single compromise orientation of the angle may be used. The orientation of the angle should be such that the debris is deflected towards a portion of the senior edge form that is wide open, and yet the designer should take care not to create undercuts or exposed promontories in the foot of the edge form, since of course it is the foot of the element that receives the most abusive forces and stresses during driving.

As mentioned, the dovetail connection at the joint should not include redundant connections. Thus, in FIG. 2, the front/rear location of the edge forms relative to each other is accomplished by means of the fit 63, as shown. Similarly, the left/right location of the edge forms is accomplished by the fit 65. It will be observed that there are no other tight connections or engagements between the edge forms that would "fight" these locating-fits. The fits 63 and 65 should be the tightest engagements between the elements: all other possible touching engagements between the elements should be more free than the locating-fits 63,65.

Although there are two cavities, there is only one dovetail connection. (The dovetail connection comprises a location-fit in the front/rear sense, and a location-fit in the left/right sense.)

The dovetail connection may be provided by specific components provided for that purpose, or the dovetail connection may be integrated into those fits between the elements that comprise the cavities. The preference for no redundancy in the location-fits applies even where the location fits include portions of the circumference of the cavity. Thus, for example, in a case where the dovetail connection were constituted by the fit of the junior portion of one of the cavities over the senior portion of that cavity, it would be important that the junior and senior portion of the other cavity were loose upon each other.

Figure 4:
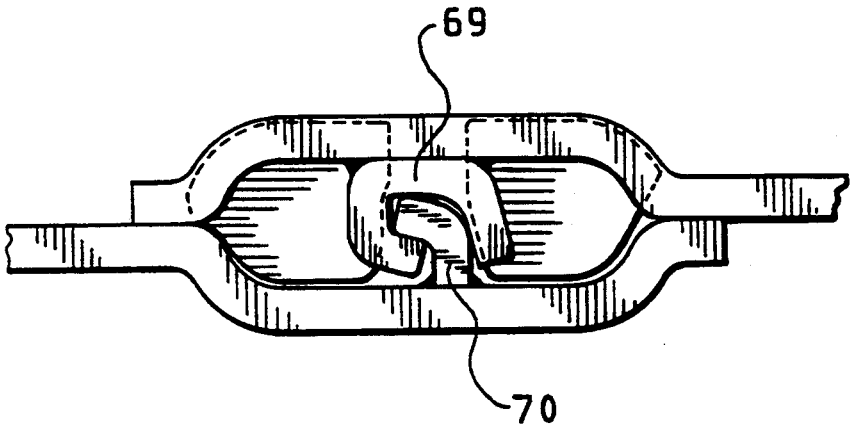
FIG. 4 is a view corresponding to FIG. 1 of a third barrier.

FIG. 4 shows an arrangement where the dovetail connection is created by the welded-on shapes, as shown, being a channel 69 and an angle 70. It may be noted that the welded-on shapes need not be continuous in the FIG. 4 arrangement: leakage of sealant between the cavities would not matter. (Leakage of water of course should not be permitted.) Where the shapes can be made in short lengths, manufacturing savings may be possible.

It was noted above that in FIG. 2 the welded-on angle 40 need not be continuously welded, since the welded connection is not required itself to be watertight. This is a matter of geometric placing, however, and it is not ruled out, in the invention, that a welded connection might be so placed that the welded connection must be watertight.

The thickness of pile-driven sheets of course varies. The invention is intended for use with sheets in the range from about 6 or 8 mm to 10 or 12 min. Such sheets are usually made of metal, ie steel; it is known however to make barrier sheets from plastic material, though in this case the sheets are generally not driven directly. Rather, a metal sheet is driven (ie hammered) in order to create a receptacle for the plastic sheet. The distinctive feature of the invention is the double cavities, which can be embodied in a plastic barrier.

Particularly in the case of the plastic barriers, the adhesive or sealant can be in the form of a cylindrical bead of water-curing material, of perhaps 6 mm diameter. The invention lends itself to this kind of sealant, in that the beads can be inserted from the surface down into the cleared cavities with little chance of being impeded.

We claim:

1. A barrier, which comprises a series of elements of sheet material, wherein, upon installation of the barrier into the ground:

each element has a senior edge form which interlocks with a junior edge form of a next adjacent element;

the configurations of interlocking pairs of senior and junior edge forms are such that the configurations thereof jointly form the circumferences of two enclosed cavities;

in respect of each of the two cavities, a portion of the circumference of the enclosed cavity is constituted by a portion of the senior edge form, and another portion of the circumference of that same enclosed cavity is constituted by a portion of the interlocking junior edge form;

in respect of each one of the two enclosed cavities, the edge forms are so shaped that each enclosed cavity includes a respective open circular space, which is defined by and inscribed wholly within the enclosed cavity, the inscribed circle being clear and open in that no portion of the material of either of the elements encroaches into the said inscribed circle;

the interlocking senior and junior edge forms are so arranged that potential leakpaths to the leakage of water through the barrier are created therebetween, and are so arranged that each and every leakpath starting from in front of the barrier and finishing behind the barrier is in communication with the said two enclosed cavities;

the interlocking edge forms are so arranged that all the potential leakpaths traverse through both the cavities, in series;

characterised in that:

the elements are so arranged as to include an interlocking dove-tail connection, being a connection which is effective to prevent displacement of the senior edge form in the horizontal sense relative to the junior edge form, and thereby to prevent consequent distortion of the cavities, the interlocking edge forms being so arranged that the two cavities, each independently of the other, are clear, open, and directly accessible from the top of the barrier, from top to bottom of the barrier;

each of the two cavities is open and accessible to the extent that a hose pipe can be passed from the top of the barrier right down inside the cavity to the bottom of the barrier;

and the two cavities are sealably independent of each other to the extent that one of the cavities can be sealed, and the potential leakpaths communicating with that cavity can be sealed, from top to bottom, independently of whether the other cavity is sealed.

2. Barrier of claim 1, wherein:

the arrangement of the interlocking edge forms is such that the potential leakpaths are comprised by contacting interfaces between the edge-forms;

the arrangement of the contacting interfaces is such that the potential leakpaths are tight and tortuous;

the potential leakpaths are tight and tortuous enough to substantially contain a sealant within the cavity.

3. Barrier of claim 2, wherein the arrangement of the interlocking edge forms is such as to define three of the said tight and tortuous pathways, the first being a pathway from one of the cavities to the front of the barrier, the second being a pathway from the other of the cavities to the rear of the barrier, and the third being a pathway between the two cavities.

4. Barrier of claim 1, wherein the inscribed circle is clear and open over a diameter of at least 18 mm.

5. Barrier of claim 1, wherein in respect of both cavities, the portion of the circumference of the cavity constituted by the junior edge form is the major portion of that circumference, and the portion of the circumference of the cavity constituted by the senior edge form is the minor portion of that circumference;

6. Barrier of claim 1, wherein the material of the elements is steel.

7. Barrier of claim 6, wherein the metal is of a thickness between 6 mm and 12 min.

8. Barrier of claim 7, wherein the elements of the barrier were inserted into the ground by being pile-driven.

9. Barrier of claim 6, wherein the material of the element is of the same thickness throughout the element.

10. Barrier of claim 9, wherein the junior edge form includes a loop and shape that is welded onto the element, and wherein the loop comprises the major portion of one of the cavities, and the welded-on shape comprises the major portion of the other of the cavities.

11. Barrier of claim 10, wherein the welded-on shape extends over the whole height of the barrier.

12. Barrier of claim 1, wherein:

the means for keeping the cavities clear of dirt and debris comprise scrapers;

the scrapers are attached rigidly and robustly to the elements, at the foot of the elements, beneath the junior edge form thereof;

each scraper is of such shape, and is so positioned beneath the junior edge form that, in a projected plan view of the barrier, the scraper substantially fully occupies the shape of a respective one of the cavities;

each cavity is open and clear above the respective scraper, to the extent that scraper can pass all the way down the senior edge form from top to bottom of the barrier.

13. Barrier of claim 12, wherein the arrangement is such that the scrapers are disposed either side of the senior element, and the scrapers are so orientated as to lie in a V-formation.

14. Barrier of claim 1, wherein:

the dovetail connection comprises means for tightly locating the interlocking edge forms together in a front/rear sense and in a left/right sense;

and the arrangement of the interlocking edge forms is such that no other engagement between the edge forms locates the edge forms to each other more tightly than the said dovetail connection.

15. Barrier of claim 1, wherein the barrier is a barrier that has been arranged according to the following procedure, in respect of each cavity:

after installation of the elements in the ground, a hose was installed in the cavity, from the top of the barrier, right down to the bottom of the barrier, and water was passed through the hose in a manner that was effective to flush out dirt and debris from the cavity;

after flushing out the cavity and withdrawing the hose, a dispensing pipe was installed in the cavity, from the top of the barrier, right down to the bottom of the barrier, sealant was injected through the pipe, and the pipe was progressively withdrawn up the cavity as the sealant was injected into the cavity.

16. A barrier, which comprises a series of elements of sheet metal, wherein, upon installation of the barrier into the ground:

each element has a senior edge form which interlocks with a junior edge form of a next adjacent element;

the configurations of interlocking pairs of senior and junior edge forms are such that the configurations thereof jointly form the circumferences of two enclosed cavities;

in respect of each of the two cavities, a portion of the circumference of the enclosed cavity is constituted by a portion of the senior edge form, and another portion of the circumference of that same enclosed cavity is constituted by a portion of the interlocking junior edge form;

in respect of each one of the two enclosed cavities, the edge forms are so shaped that each enclosed cavity includes a respective open circular space, which is defined by and inscribed wholly within the enclosed cavity, the inscribed circle being clear and open in that no portion of the material of either of the elements encroaches into the said inscribed circle;

the inscribed circle of each cavity being clear and open over a diameter of at least 18 mm;

the junior edge form includes a loop and shape that is welded onto the element, and wherein the loop comprises the major portion of one of the cavities, and the welded-on shape comprises the major portion of the other of the cavities;

the interlocking senior and junior edge forms are so arranged that potential leakpaths to the leakage of water through the barrier are created therebetween, and are so arranged that each and every leakpath starting from in front of the barrier and finishing behind the barrier is in communication with the said two enclosed cavities;

the interlocking edge forms are so arranged that all the potential leakpaths traverse through both the cavities, in series;

each of the two cavities is open and accessible to the extent that a hose pipe can be passed from the top of the barrier right down inside the cavity to the bottom of the barrier;

and the two cavities are sealably independent of each other to the extent that one of the cavities can be sealed, and the potential leakpaths communicating with that cavity can be sealed, from top to bottom, independently of whether the other cavity is sealed.

* * * * *